US007271785B2

(12) United States Patent
Jang

(10) Patent No.: US 7,271,785 B2
(45) Date of Patent: Sep. 18, 2007

(54) ORGANIC ELECTROLUMINESCENCE DISPLAY PANEL AND DISPLAY APPARATUS USING THEREOF

(75) Inventor: Hyeon-Yong Jang, Ohsan (KR)

(73) Assignee: Samsung Electronics Co., Ltd. (KR)

( * ) Notice: Subject to any disclaimer, the term of this patent is extended or adjusted under 35 U.S.C. 154(b) by 99 days.

(21) Appl. No.: 10/491,032

(22) PCT Filed: Jan. 3, 2002

(86) PCT No.: PCT/KR02/00005

§ 371 (c)(1),
(2), (4) Date: Oct. 7, 2004

(87) PCT Pub. No.: WO03/037040

PCT Pub. Date: May 1, 2003

(65) Prior Publication Data

US 2005/0052365 A1 Mar. 10, 2005

(30) Foreign Application Priority Data

Sep. 28, 2001 (KR) ..... 10-2001-0060444

(51) Int. Cl.
*G09G 3/30* (2006.01)

(52) U.S. Cl. ..... 345/80; 345/205; 315/169.3

(58) Field of Classification Search ..... 345/76, 345/80, 82, 204–206; 315/169.3
See application file for complete search history.

(56) References Cited

U.S. PATENT DOCUMENTS 5,786,796 A * 7/1998 Takayama et al. ..... 345/76
6,084,579 A * 7/2000 Hirano ..... 345/205
6,157,356 A 12/2000 Troutman ..... 345/82
6,351,078 B1 * 2/2002 Wang et al. ..... 315/169.3
6,617,796 B2 * 9/2003 Sasaki et al. ..... 315/169.1

FOREIGN PATENT DOCUMENTS

| | | |
|---|---|---|
| JP | 11-272233 | 10/1999 |
| JP | 2001-183996 | 7/2001 |
| KR | 1020010062484 | 7/2001 |

OTHER PUBLICATIONS

PCT International Search Report; International application No.: PCT/KR02/00005; International filing date: Jan. 3, 2002; Date of Mailing: Jun. 24, 2002.

PCT International Preliminary Examination Report; International application No.: PCT/KR02/00005; International filing date: Jan. 3, 2002; Date of Completion: Jan. 28, 2004.

* cited by examiner

*Primary Examiner*—Amr A. Awad
*Assistant Examiner*—Tom V. Sheng
(74) *Attorney, Agent, or Firm*—Cantor Colburn LLP

(57) ABSTRACT

The organic EL display panel according to the present invention includes; a plurality of data lines, a plurality of scan lines, switching elements of which second ends are connected to the scan lines to turn currents on and off and pixel electrodes provided in specific areas disposed in a matrix among the data lines and the scan lines, embedding specific impedance elements, and, emitting light by being supplied with level-reduced voltages by the impedance elements according to data signals inputted through the first ends of the switching elements.

10 Claims, 8 Drawing Sheets

ORGANIC ELECTROLUMINESCENCE DISPLAY PANEL AND DISPLAY APPARATUS USING THEREOF

BACKGROUND OF THE INVENTION (a) Field of the Invention

The present invention relates to an organic electroluminescence (EL) display panel and a display thereof, and more in particular, to an organic EL display panel and an organic EL display having the same, which are simple and can overcome the limit of gray display due to characteristic distributions of TFTs.

(b) Description of the Related Art

As displays used currently, there are the most employed CRTs, and the ratio of LCDs for computers is gradually increasing. However, the CRTs are too heavy and have large volume, and the LCDs are not bright and cannot be seen from the side and are low in the aspect of effectiveness, thereby not satisfying users perfectly.

Thus, many researchers try to develop cheaper, more effective, thinner and lighter displays, and one of attractive displays as a next generation display is an OLED (Organic Light Emitting Device).

This OLED uses electroluminescence (EL: a phenomenon of generating light on applying electricity) of specific organic materials or high molecules, and it is not provided with back light. Accordingly, since the OLED has advantages that it can be slim and manufactured simply and at lower cost and has a wide viewing angle and generates bright light compared with the LCD, a research for it is vigorously proceeding worldwide.

FIG. 1 is a circuit diagram to illustrate an example of a normal organic EL driving device.

Referring to FIG. 1, a normal organic EL driving device is composed of a switching transistor $Q_S$, a storage capacitor Cst, a driving transistor $Q_D$ and a organic EL device OLED.

At the time of operation, the organic EL display employs not a passive driving method that light is emitted only in selecting one transverse scan line, but an active driving method, which enlarges the light-emitting duty considerably, since its brightness is low relative to CRT. In this case, an active layer of the light-emitting cell emits light in proportion to an injected current density.

However, there is a problem that the conventional organic EL driving device is very simple in a driving circuitry thereof but must be applied with voltages from an external device and also the organic EL device must be applied with voltages.

In common, the organic EL device is difficult to display gray since it is very sensitive to applied voltages and its variation is very large.

In order to overcome these disadvantages, a cell driving unit is provided that current are applied from an external device and a cell is applied with current in an amount of the applied current, as shown in FIG. 2 of SID 01 Digest p.384.

FIG. 2 is a circuit diagram to illustrate another example of a conventional or EL device.

Referring to FIG. 2, a brightness data as current is applied from an external device so as to apply the current to the organic EL cell, and selection signals are applied to respective horizontal lines of a screen at corresponding timing to supply the brightness data to a specific coordinate.

This supplied brightness data enables to flow current with the same value as the current to the organic EL device through current mirror circuits QS1 and QS2. Thereafter, when the present horizontal line is stopped and that of the next stage is selected, the storage capacitor Cst keeps a gate voltage of the TFT QS2 required to flow the current to the organic EL device and thus it enables to flow the current to the organic EL device until new brightness data and a horizontal line (column line) selection signal are inputted.

However, the aforementioned FIG. 2 has problems as following.

That is, a specific scan line SCAN 1, and a current mirror operation and a current storage operation selection wire SCAN 2 is needed as a pair.

This has problem that the number of a vertical scan wire and a driving become double to be disadvantageous in terms of production yield and price thereof.

In addition, since the brightness data is a current, an existing voltage-driven IC cannot be used, and a current-driven IC has a difficulty more than the voltage-driven IC, in terms of techniques.

Moreover, the characteristics of a plurality of thin film transistors ("TFTs") provided in the respective cells of the organic EL must be uniform in order to be operated as current mirrors, and the characteristics among the TFTs provided in the other cells must be uniform, too. The TFTs as current mirrors operate not in a switching mode but in an active mode, and thereby requiring optimal characteristics.

In addition, when the variation of the characteristic in threshold input voltage of the TFT to supply a current to the organic EL occurs, the variation of output occurs to supply currents different from the brightness data, thereby causing the variation of brightness. Thus, it is difficult to implement a detailed gray.

As described above, for all increasing the number of the vertical scan lines and the driving IC, the conventional organic EL driving cell has many problems.

SUMMARY OF THE INVENTION

An object of the present invention is to provide an organic display panel for overcoming the limit of gray display due to TFT characteristic distributions existing in an organic EL panel, which is decreased in the number of horizontal scan lines and driving ICs to be simplified.

Another object of the present invention is to provide an organic EL display with the organic EL display panel.

An organic EL display panel according to one aspect for realizing the object the present invention, which includes:

a plurality of data lines transmitting data signals;

a plurality of scan lines lying at right angle to the data lines and transmitting scan signals;

switching elements of which first ends are connected to the data lines and second ends are connected to the scan lines to turn on and off currents; and pixel electrodes provided in specific areas disposed in a matrix among the data lines and the scan lines, embedding specific impedance elements, and, emitting lights for itself by being supplied with level-downed voltages by the impedance elements according to data signals inputted through the first ends of the switching transistors.

In addition, an organic EL display according to one aspect for realizing another object of the present invention, which includes:

a timing controller supplied with image signals and a control signal thereof to output a first and a second timing signals, and outputting a power control signal;

a column driver supplied with the image signals and the first timing signals to output data signals;

a row driver supplied with the second timing signal to output scan signals;

a power supply supplied with the power control signal to output a switched power;

an organic EL display panel comprising a plurality of data lines, a plurality of scan lines, switching elements of which second ends are connected to the scan lines to turn on and off currents, and pixel electrodes provided in specific areas disposed in a matrix among the data lines and the scan lines, embedding specific impedance elements, and, emitting lights for itself by being supplied with level-reduced voltages by the impedance elements according to data signals inputted through the first ends of the switching elements.

According to this organic EL display panel and the organic EL display with same, it is possible to simplify the organic EL panel by decreasing the number of horizontal scan lines and driving ICs, and it is possible to overcome the limit of gay display by decreasing varied widths of the corresponding driving device through the embedded impedance element even if inherent threshold values belonging to the driving devices provided in the pixel electrodes are different.

DETAILED DESCRIPTION OF PREFERRED EMBODIMENTS

Now, embodiments will be described for those skilled in the art to practice the present invention easily.

Figure 3:
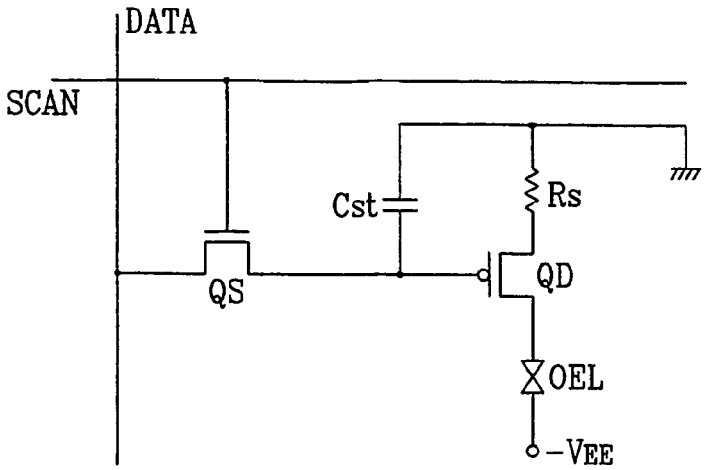
FIG. 3 is a diagram to illustrate an equivalent circuit of an organic EL display according to an embodiment of the present invention.

FIG. 3 is a diagram to illustrate an equivalent circuit of an organic EL display according to an embodiment of the present invention.

Referring to FIG. 3, the organic EL display according to the embodiment of the present invention includes: a plurality of data lines DATA transmitting data signals; a plurality of scan lines SCAN lying at right angle to the data lines and transmitting scan signals; switching transistors QS of which first ends are connected to the data lines and second ends are connected to the scan lines to turn on and off currents; and pixel electrodes provided in specific areas disposed in a matrix among the data lines and the scan lines and emitting lights for itself according to data signals inputted through the first ends of the switching transistors QS.

Each of the pixel electrodes is composed of a storage capacitor Cst, a source resistor Rs, a driving transistor QD and an organic EL device OEL.

The storage capacitor of which one end is grounded and the other end is supplied with a driving voltage through a third end of the switching transistor QS to store up charges. The source resistor Rs is connected to one end of the storage capacitor.

The driving transistor QD is turned on/off in response to data signals inputted through a first end, and then, outputs a level-down driving voltage by the source resistor Rs connected to a second end through a third end.

The organic EL device OEL is provided with an organic EL driving voltage−VEE of negative polarity from an external device through one end and is connected to the third end of the driving transistor through the other end, and it emits lights for itself according to currents flowing by a difference of the organic EL driving voltage and the above driving voltage.

In FIG. 3, although it has been described that the organic EL device is directly provided with the organic EL driving voltage of negative polarity, it is possible that the end of the organic EL device is grounded and the end of the storage capacitor Cst is provided with an organic EL driving voltage. Of course, the organic EL driving voltage is preferably positive polarity+$V_{EE}$.

Figure 4:
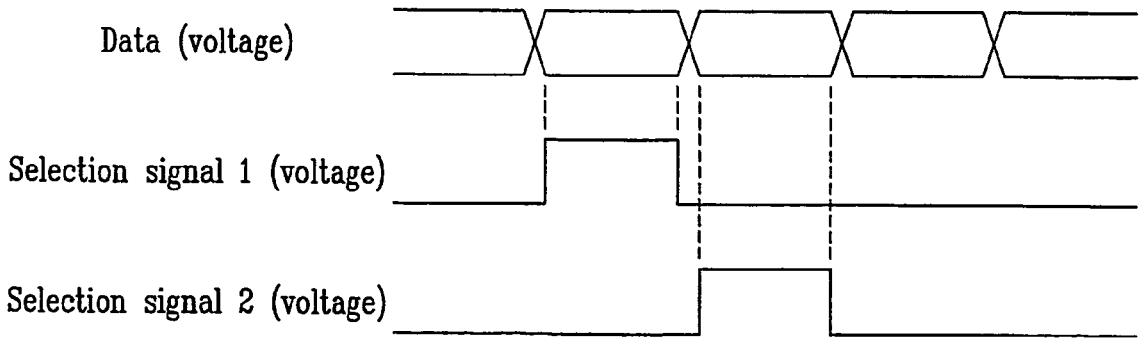
FIG. 4 is a timing diagram to illustrate driving of an organic EL display according to the present invention.

FIG. 4 is a timing diagram to illustrate a driving of the organic EL display according to the present invention, and in particular, to illustrate data voltages and a first line selection signal and a second line selection signal inputted to the neighboring scan lines, respectively.

Referring to FIGS. 3 and 4, an operation thereof will be described in detail.

First, when the data voltage becomes low level and simultaneously the first selection signal is in an active state (or high level), the switching transistor QS is turned on, and then the storage capacitor Cst is charged with negative charges.

When the storage capacitor Cst is charged with the same level of voltage as the value of the data voltage of the first selection signal, the present first selection signal becomes low level and the storage capacitor Cst stop charging and simultaneously the second selection signal, which is next order in image frames, is in an active state. Herein, the second selection signal selects new data voltage to charge the storage capacitor Cst (not shown) provided in next stage, repeatedly.

In this way, once the storage capacitor Cst is charged with charges, the gate of driving transistor QD is negative polarity, and thus, the driving transistor QD as a P-MOS FET is turned on.

Accordingly, the currents pass through the ground GND, the source resistor Rs, the driving transistor QD and the organic EL device OLE, and flow to the organic EL driving voltage source−$V_{EE}$ of negative polarity, and thereby the organic EL device becomes a state of light-emitting.

In addition, when the data voltage is high level and simultaneously the first selection signal is in an active state (or high level), the switching transistor QS is turned off, and the charges of negative polarity in the storage capacitor Cst is discharged to the ground. In the end, since the ground potential of the storage capacitor Cst does not reach the gate threshold of the driving transistor QD to turn off the driving transistor QD, the organic EL device is not provided with currents to be in the state of non light-emitting.

As described above, since the brightness of light-emitting of the organic EL display is determined depending on whether the data signal is high level or low level, only lights-on and lights-off exist in a gray display thereof.

In this case, the driving transistor QD satisfies only a characteristic of saturation area very easy to manufacture compared with a characteristic of active area hard to manufacture. That is, transistors for digital are preferably used rather than transistors for analog.

Providing a characteristic of saturation area to the driving transistor QD may not display gray, but cells explained in "SID 00 Digest p927, 36.4L" published by K. Inukai, use light-emitting or non light-emitting, and one frame is divided into several sub-fields having brightness weights, and thereby it is possible to display gray.

That is, when a display-period-separated (hereinafter, "DPS") driving method or a simultaneous-erasing-scan (hereinafter, "SES") driving method is used, even if the driving transistor with a characteristic of saturation area is used, it is possible to display gray easily.

Meanwhile, a required condition that each of the organic EL devices has the same brightness characteristics when the all the organic EL devices emit lights, must be satisfied in using the DPS driving method or the SED driving method.

In practice, when the currents flowing through the organic EL device are constant, the organic EL device is more sensitive to distribution of conductive on-resistance of the driving transistor QD than that of light-emitting brightness characteristic.

A switching element used for an organic EL device is MOS-type transistor (MOSFET), and the characteristic of resistance at the time of turn-on is dependent on a threshold voltage of the gate of the MOSFET. In a practical process, it is very difficult to uniformly manufacture characteristics of threshold voltage Vth of all the switching transistors QS within one frame.

For this reason, in the present invention, the characteristic of the organic EL light emitting of each pixel is not sensitive to the threshold voltage characteristic, and is also made to be constant even if a characteristic distribution exists a little in the EL device.

Now, a method, by which many organic EL devices formed in a matrix type within an organic EL panel have uniform characteristics, will be described.

Figure 5A:
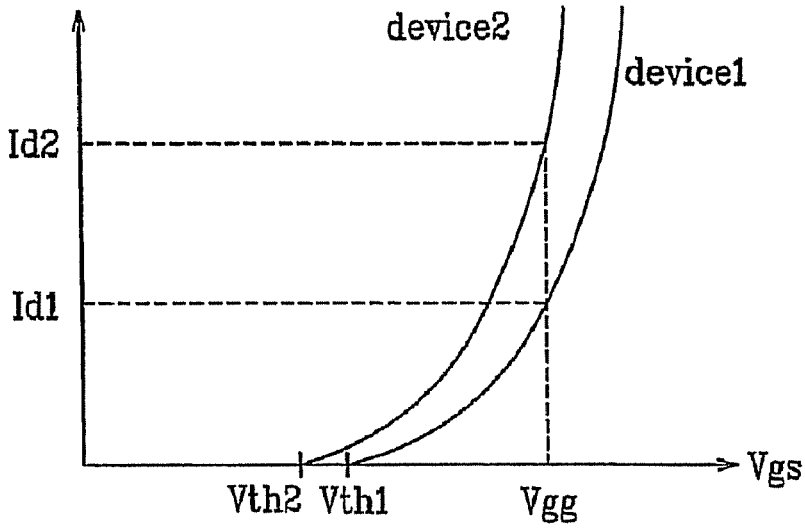
FIG.5A PRIOR ART
FIG. 5A is a diagram to illustrate a characteristic of voltage to current in a switching element of a conventional organic EL display.
Figure 5B:
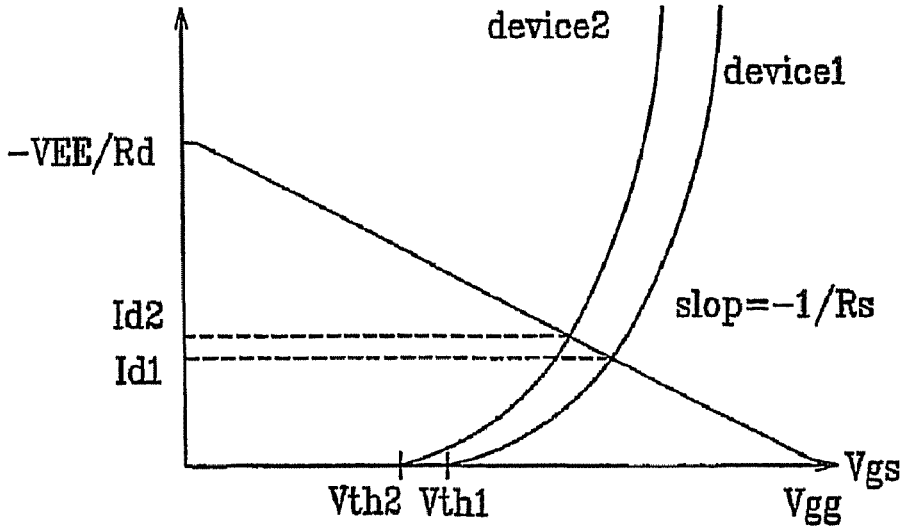
FIG. 5B is a diagram to illustrate a characteristic of voltage to current in a switching element of the present invention.

FIG. 5A is a diagram to illustrate a characteristic of voltage to current in a switching element of a conventional organic EL display, and FIG. 5B is a diagram to illustrate a characteristic of voltage to current in a switching element of the present invention.

When a switching transistor QS is conductive, a storage capacitor Cst is charged with negative polarity compared with ground GND, and this charged voltage is applied to a gate of a driving transistor QD to be turned on, since the driving transistor QD is a P type MOSFET. Herein, the charged voltage is referred to as Vgg, a voltage across the gate terminal and the source terminal of the driving transistor QD as Vgs, a voltage across the source resistor Rs as Vrs, a current flowing through the drain-to-source of the driving transistor QD as Id, a threshold voltage, which the driving transistor QD has inherently, as Vth.

Figure 1:
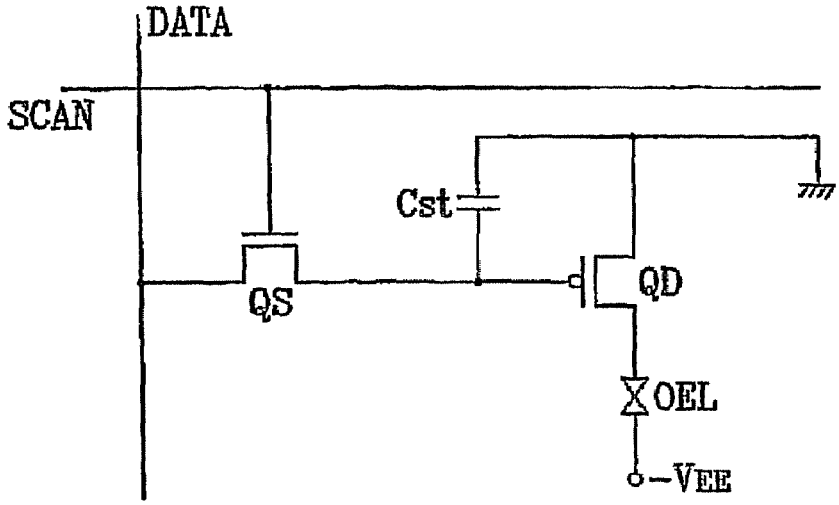
FIG.1 PRIOR ART
FIG. 1 is a circuit diagram to illustrate an example of a normal organic EL driving device.
Figure 2:
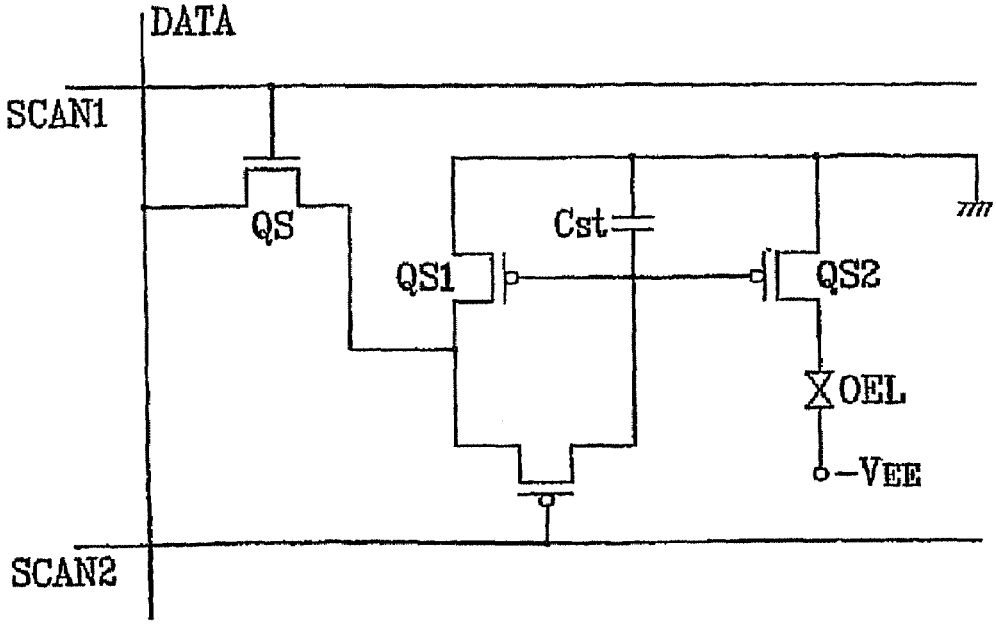
FIG.2 PRIOR ART
FIG. 2 is a circuit diagram to illustrate another example of a conventional organic EL driving device.

As shown in FIGS. 1 and 2 of the prior art, in case the source terminal of the driving voltage QD does not have the source resistor Rs, that is, the source resistance is 0, the threshold voltages Vth are different for respective driving transistors. Accordingly, Vgs-Id characteristic are as shown in FIG. 5A.

With reference to FIG. 5A, assuming that a threshold voltage of a MOSFET device 1 having a certain driving transistor is referred to as Vth1 and a current through drain-to-source thereof is referred to as Id1, and a threshold voltage of a MOSFET device 2 having a certain driving transistor is referred to as Vth2 and a current through drain-to-source thereof is referred to as Id2, the output current Id is very sensitively varied depending on a variation of the threshold voltage Vth, which each driving transistor QD inherently has.

Meanwhile, as shown in FIG. 5B, in the exemplary embodiment where the source resistor Rs is provided in the source terminal of the driving transistor QD, it can be seen that an amount of variation of the output current Id1 and Id2 is very small compared with a conventional organic EL cell without the source resistor.

In other words, when the source terminal of the driving transistor QD does not have the source resistor Rs, the voltage Vgg across the gate-to-source of the driving transistor QD is applied accurately, however, when the source terminal thereof has the source resistor Rs, the variation of the current becomes smaller only if a voltage more than the threshold voltage of the gate thereof is applied thereacross.

The above description may be described by the following expressions:

$$Vgg = Vgs + V_{Rs} = Vgs + Id\mathrm{E}Rs \tag{1}$$

$$Id = \frac{Vgg}{Rs} - \frac{Vgs}{Rs} \tag{2}$$

$$\Delta V_{Rs} = Rs\mathrm{E}\Delta Id \tag{3}$$

$$\Delta Vgs = -\Delta V_{Rs} = -Rs\mathrm{E}\Delta Id \tag{4}$$

As described above, the driving transistor has an advantage that it operates more or less stably against uniformity of the device itself and a variation of drift to temperature since negative feedback is generated due to a voltage across the source resistor Rs.

In other words, there is an advantage that, since the value of the source resistor Rs does not require an accurate value, the operation of the driving transistor can be stabilized even if some variation exists on manufacturing of an organic EL panel. Only a difference is the negative-feedback voltage and the output current is hardly varied. As the value of the source resistor Rs becomes greater, the driving transistor is stabilized, however it is effective to increase the charged voltage Vgg sufficiently to operate the driving voltage.

Figure 6:
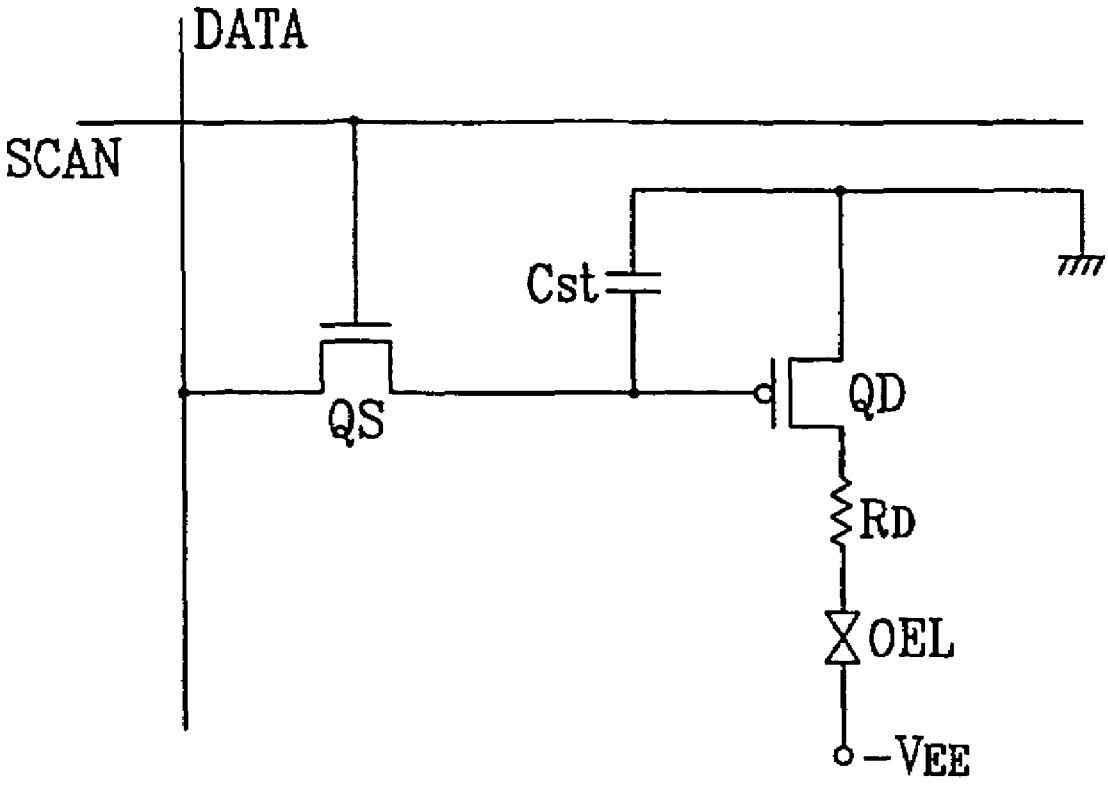
FIG. 6 is a diagram to illustrate an equivalent circuit of an organic EL display according to another embodiment of the present invention.

FIG. 6 is a diagram to illustrate an equivalent circuit of an organic EL display according to another embodiment of the present invention. Alternately, the resistor is implemented so as to be connected to the drain terminal of the driving transistor instead of the source terminal thereof compared with FIG. 3.

Although the above embodiments have been explained examples, in which the resistors are provided, it is possible to implement the present invention by using other elements with resistive characteristics instead of resistors.

Figure 7:
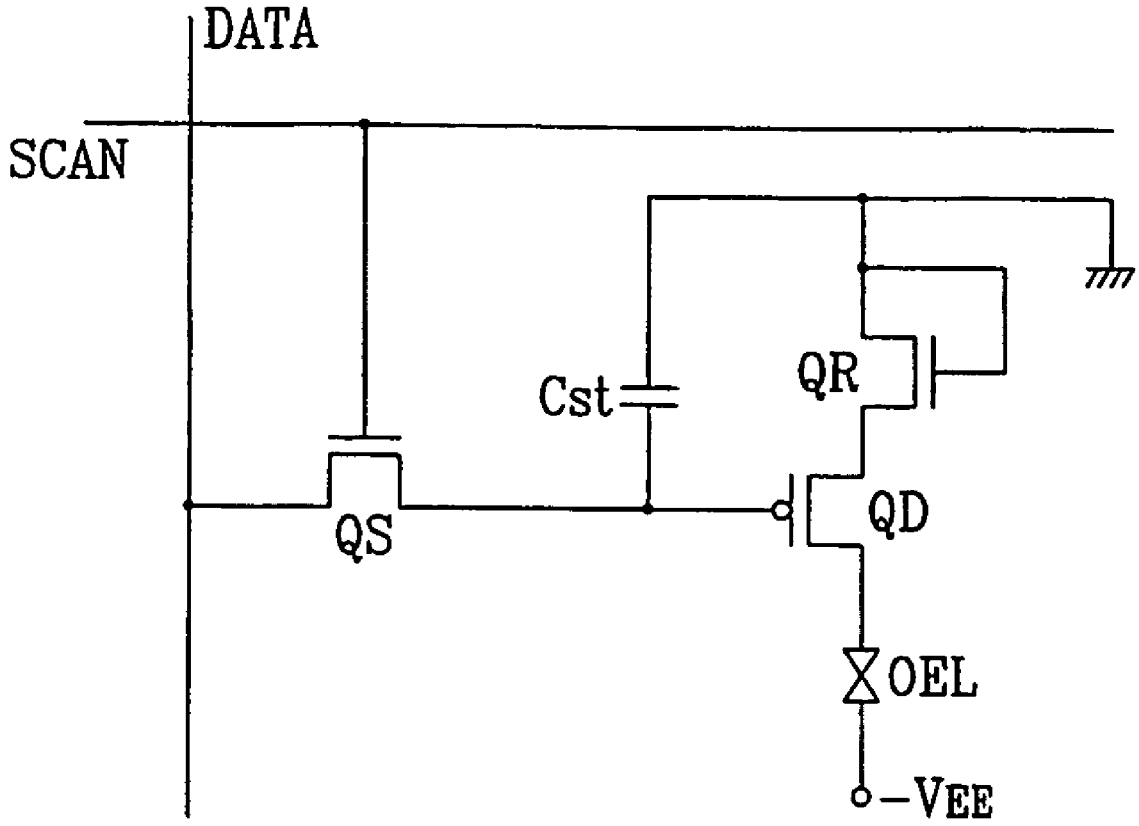
FIG. 7 is a diagram to illustrate an equivalent circuit of an organic EL display according to still another embodiment of the present invention.

FIG. 7 is a diagram to illustrate an equivalent circuit of still another embodiment according to the present invention, which is an example using an enhancement N-type MOSFET with a resistive characteristic instead of a resistor.

In this case, when a drain terminal and a gate terminal of the enhancement MOSFET are connected to each other, it has a characteristic similar to a diode, as known in the art. In particular, when an active area, in which the operating point is beyond the threshold voltage, its effect is the same as that using a resistor.

Moreover, implementing a MOS transistor instead of a resistor on a semiconductor substrate has an advantage to decrease an arrangement area. Here, a current-to-voltage characteristic is varied depending on a variation of the threshold voltage of the MOS transistor, and this may be regarded as a variation of load. However, even if the source resistor has a wide range of variation, the MOSFET to drive the organic EL device has no difficulty in operating stably.

Figure 8:
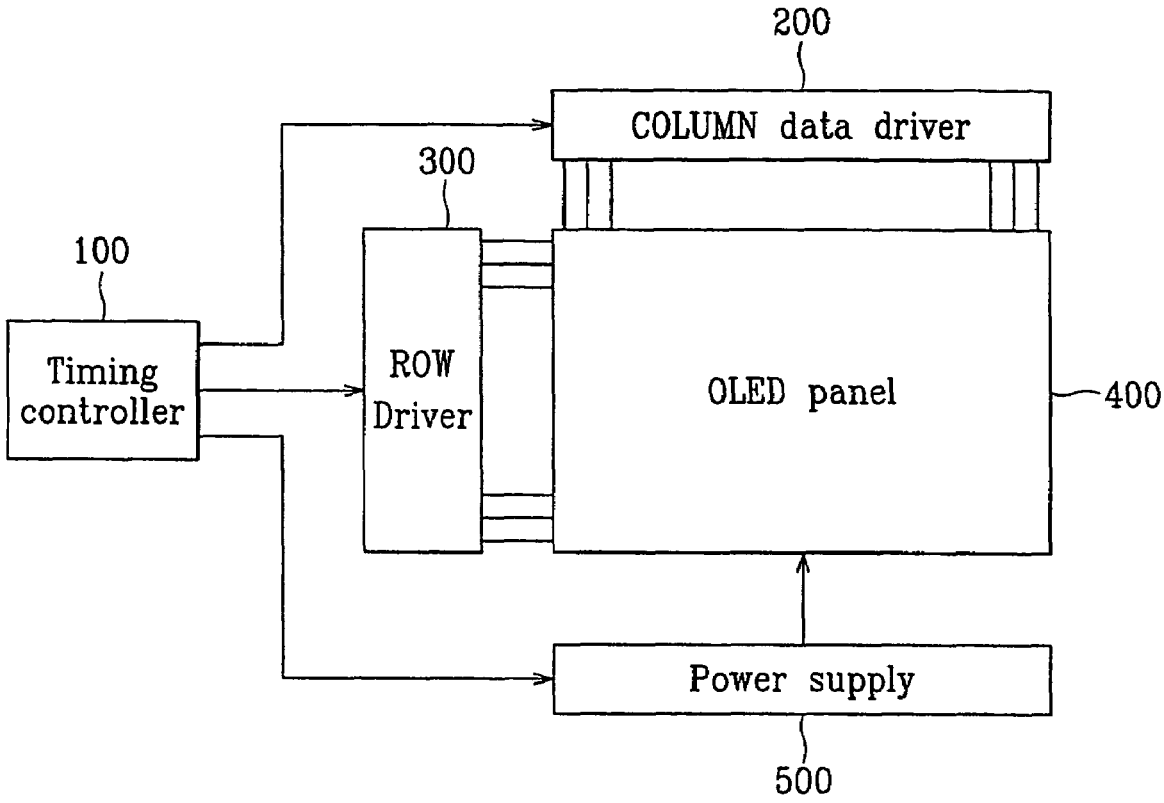
FIG. 8 is a diagram to illustrate an organic EL display according to an embodiment of the present invention.

FIG. 8 is a diagram to illustrate an organic EL display according to an embodiment of the present invention.

Referring to FIG. 8, the organic EL display according to the embodiment of the present invention includes a timing controller 100, a column data driver 200, a row driver 300, an organic EL panel 400 and a power supply 500.

The timing controller 100 is provided with a image signal and a signal controlling the image signal from an external device to generate a first and a second timing signals, and then, outputs the first timing signal to the column data driver 200 and the second timing signal to the row driver 300 and a power control signal to the power supply 500.

The column data driver 200 is provided with the image signal and the first timing signal from the timing controller 100 and outputs data signal to the organic EL panel 400.

The row driver 300 is provided with the second ting signal from the timing controller 100 and outputs a scan signal to the organic EL panel 400.

The organic EL panel 400 includes: a plurality of data lines; a plurality of scan lines; switching elements of which first ends are connected to the data lines and second ends are connected to the scan lines to turn on and off currents; and pixel electrodes provided in specific areas disposed in a matrix among the data lines and the scan lines and emitting lights for itself according to differences of switching voltages inputted through common ends and data signals inputted through the first ends of switching elements. The organic EL panel displays the image signals from the column data driver 200 based on the scan signals from the row driver 300. Of course, herein, the organic EL panel preferably includes the pixels shown in FIG. 3, FIG. 6 or FIG. 7.

The power supply 500 is provided with the power control signal to output a switched power.

Now, a description will be made of a driving example in connection with a DPS driving method.

Figure 9:
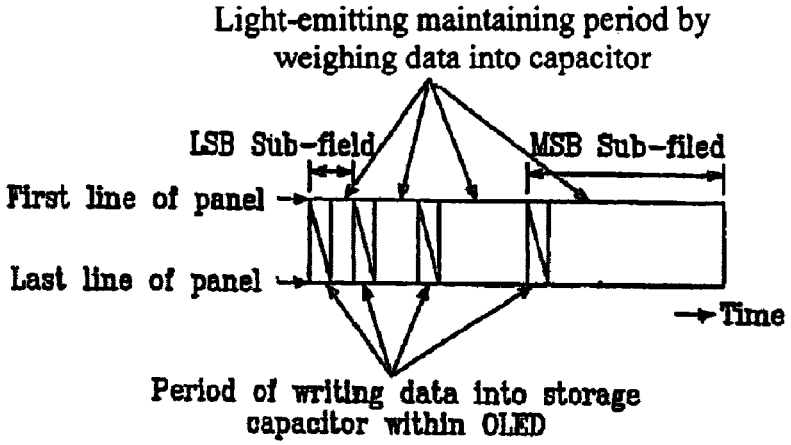
FIG. 9 is a diagram to illustrate a DPS method inputted to the organic EL display panel of FIG. 8.

FIG. 9 is a diagram to illustrate the DPS driving method inputted to the organic EL display panel of FIG. 8.

Referring to FIGS. 8 and 9, the timing controller 100 sends a brightness data to be displayed to the column data driver 200 and simultaneously sends a control signal to the row driver for selecting transverse lines of the organic EL panel 400. In this case, the brightness data is stored in a high level or a low level into the storage capacitor Cst comprising each cell within the organic EL panel 400.

When scan for first line to last line of the organic EL panel is completed, the scan operation stops, and the power supply 500 shown in FIG. 8 supplies a predetermined power to the organic EL devices at the same time to emit or not to emit lights according to the charges of the cells at the time of scan.

A scan period and a light-emitting period forms a pair to become one sub-field. The one frame is composed of six to eight sub-frames (or sub-field) (four sub-fields in FIG. 9), and differences of respective sub-fields are different depending on a digital number of light-emitting periods, i.e., weights.

In other words, the LSB sub-field is a period displaying the smallest brightness, and LSB+1 sub-field is a period $2^1$ times larger than the LSB, and LSB+2 sub-field is a period $2^2$ times larger than the LSB.

Gray is displayed according to binary of image brightness data by using this method. It is possible to display gray by using the DPS driving method or the SES driving method with only light-emitting or non light-emitting of the present invention.

Figure 10:
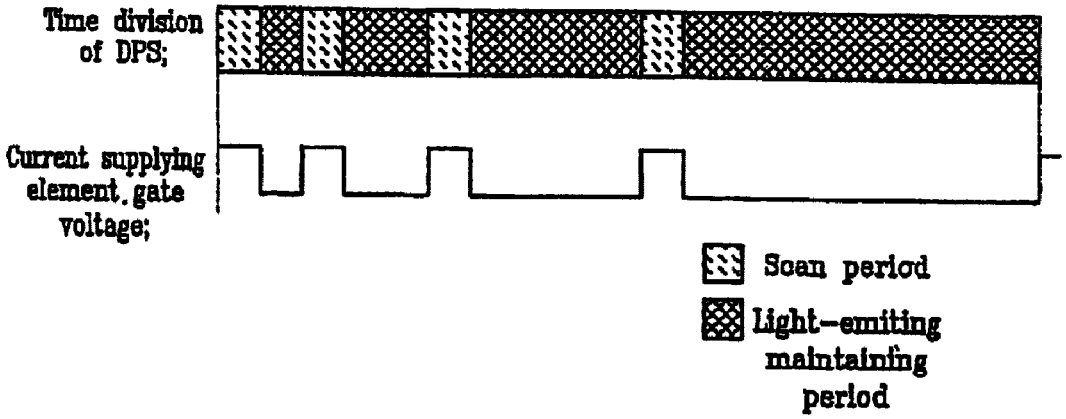
FIG. 10 is a timing diagram to illustrate an applied organic EL current source during a storage light-emitting period when the DPS method of FIG. 9 is used.

FIG. 10 is a timing diagram to illustrate an applied organic EL current source during a storage light-emitting period when the DPS method of FIG. 9 is used.

Referring to FIG. 10, a gate voltage of a current supplying element is controlled to distribute time of the DPS driving method. That is, it is possible to implement the DPS driving method by using a method that, during a scan period of the organic EL panel, the gate voltage of the current supplying element is made to be high level, and, during a light-emitting maintaining period, the gate voltage thereof is made to be low level.

Figure 11:
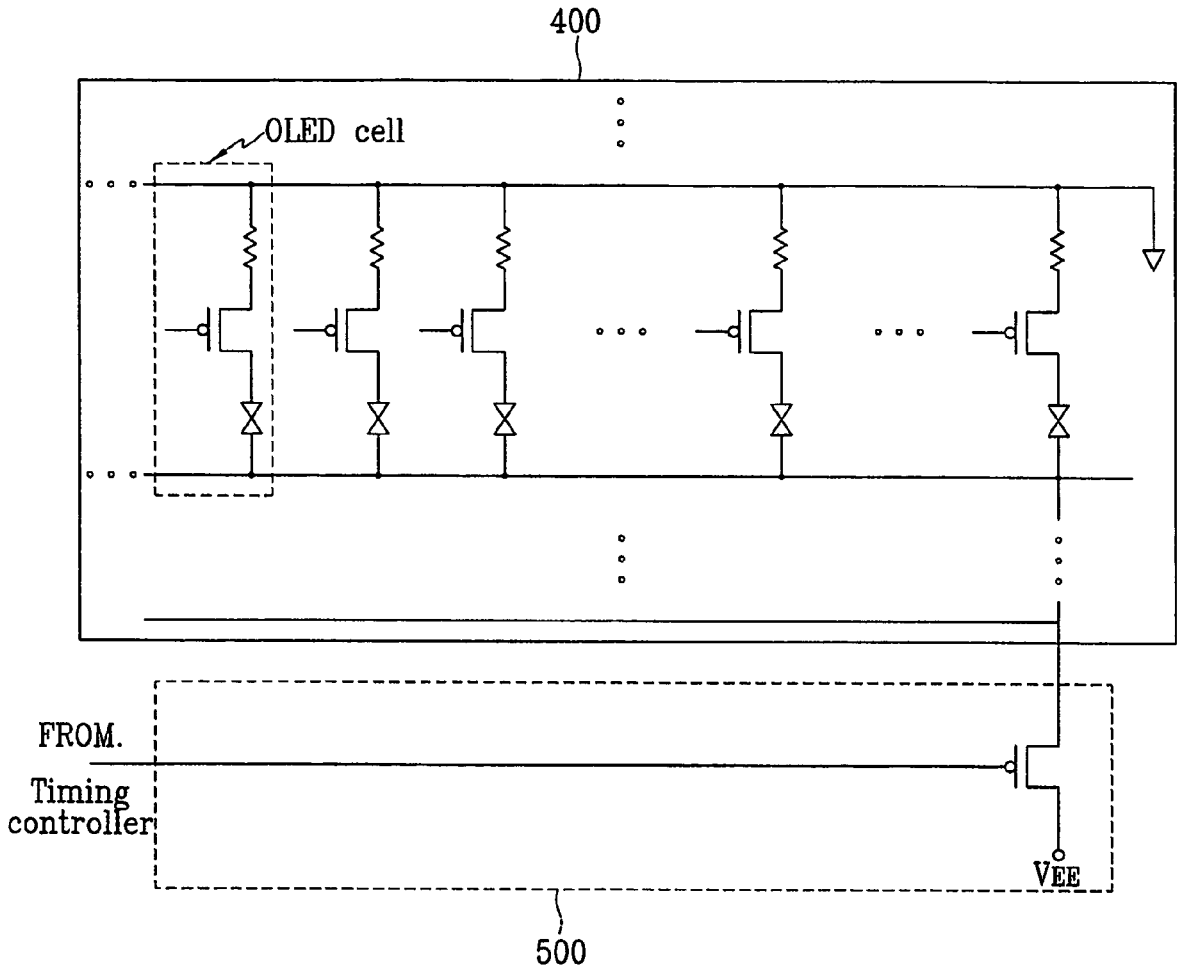
FIG. 11 is a diagram to illustrate the organic EL display panel and the power supply of FIG. 8.

FIG. 11 is a diagram to illustrate the organic EL display panel and the power supply of FIG. 8.

Referring to FIG. 11, the DPS driving method is divided into data scan periods and light-emitting maintaining periods, and the current is supplied to the organic EL device only during the light-emitting maintaining periods.

That is, in the respective organic EL driving cells (or OLED cells), one ends of the organic EL devices are connected to drains of the switching MOSFET, and the other ends thereof are connected to the other ends of another organic EL devices within the organic EL panel 400 and are also connected to drains of power switching MOSFET provided in the power supply 500. In this case, source terminals of the power switching MOSFET are connected to a VEE constant voltage source and gate terminals thereof are supplied with power switching signals from the timing controller 100 to output the VEE constant voltages to common terminal of the organic EL device formed in the organic EL panel 400. Here, the power switching MOSFET is preferable P-type.

In operation, if negative voltage is applied to the gate of P MOSFET during the light-emitting period, the power switching MOSFET is turned on to supply currents to all the organic EL driving cells within the organic EL panel 400 at one time.

In this way, separate current supplying devices need not be provided in the organic EL panel, and it is possible to reduce an influence on characteristic distributions of the organic EL devices.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

As described above, according to the present invention, by adding impedance elements working as electrical resistors to the source terminals of the driving transistors of the organic EL driving cells, it is possible to make characteristic distributions of threshold voltages of the driving transistors provided in respective cells within the organic EL display panel to be constant, and to make output currents according to characteristic distributions of ratio of input voltages-tooutput currents per the organic EL devices to be constant, and it is possible to display gray of high level.

In addition, it is possible to display a desired gray level using only a transistor having digital characteristics, which is easy to manufacture and has a high production yield, although not using a transistor having analog characteristics.

In addition, it is possible to use a conventional driving IC, which is a voltage output mode and is outputted with on/off in writing the data into the organic EL driving cells.

Moreover, in case of a current driving mode cell, additional scan lines need not be provided to be simple in structures of cells, and thus, a production yield can be increased and additional driving ICS need not be provided.

Moreover, it is possible to reduce characteristic distributions, since a current supplying element can be configured with a single power switching element at external portion, when the DPS driving method is used.

What is claimed is:

1. An organic EL display panel comprising:

a plurality of pixels formed in substantially a matrix arrangement by a plurality of data lines transmitting data signals and a plurality of scan lines lying at substantially a right angle to the data lines and transmitting scan signals;

switching transistors formed in each pixel, the switching transistors having input terminals connected to the data lines and control terminals connected to the scan lines;

pixel electrodes provided in the plurality of pixels, each pixel electrode further comprising an embedded impedance element, and a storage capacitor having one end connected to a ground voltage, wherein the switching transistors turn on and off current to the pixel electrodes and, the pixel electrodes emit light when supplied with voltages, which are lowered by the impedance elements, according to data signals inputted through the input terminals of the switching transistors, and wherein each of the pixel electrodes comprises:

the storage capacitor having one end grounded and the other end connected to an output terminal of the switching transistor, the storage capacitor charging a driving voltage from the switching transistor;

a driving device responding to the data signal input through a control terminal thereof to output the charged driving voltage, which it receives through an input terminal thereof from the storage capacitor, through an output terminal thereof;

the impedance element having one end connected to the output terminal of the driving device, which reduces the voltage level of the driving voltage received from the driving device; and an organic EL device connected to the impedance element, wherein the organic EL device is supplied on its opposite end with an organic EL driving voltage from an external device, and thereby emits light according to a difference between the organic EL driving voltage and the reduced driving voltage at the other end of the impedance element.

2. The organic EL display panel of claim 1, wherein the impedance element is a resistor.

3. The organic EL display panel of claim 1, wherein the impedance element is a MOS transistor.

4. The organic EL display panel of claim 1, wherein one end of the organic EL device is connected in common to one end of an adjacent organic EL device to be supplied with the organic EL driving voltage through a common connection terminal.

5. The organic EL display panel of claim 1 wherein the data signals are constant voltages of on/off level.

6. An organic EL display comprising:

a timing controller supplied with image signals and a control signal and outputting first and second timing signals and a power control signal;

a column driver supplied with the image signals and the first timing signals to output data signals;

a row driver supplied with the second timing signal to output scan signals;

a power supply supplied with the power control signal to output a switched power; and an organic EL display panel comprising a plurality of pixels formed in substantially a matrix arrangement by a plurality of data lines and a plurality of scan lines, switching elements having input terminals connected to the scan lines, pixel electrodes provided in the plurality of pixels, each pixel electrode further comprising an embedded impedance element, and a storage capacitor having one end connected to a ground voltage, wherein the switching elements turn on and off current to the pixel electrodes and, the pixel electrodes emit light when supplied with voltages, which are lowered by the impedance elements, according to data signals inputted through the input terminals of the switching elements, and wherein each of the pixel electrodes comprises:

the storage capacitor having one end grounded and the other end connected to an output terminal of the switching element, the storage capacitor charging a driving voltage from the switching element;

a driving device responding to the data signal input through a control terminal thereof to output the charged driving voltage, which it receives through an input terminal thereof from the storage capacitor, through an output terminal thereof;

the impedance element having one end connected to the output terminal of the driving device, which reduces the voltage level of the driving voltage received from the driving device; and an organic EL device connected to the impedance element, wherein the organic EL device is supplied on its opposite end with an organic EL driving voltage from an external device, and thereby emits lights according to a difference between the organic EL driving voltage and the reduced driving voltage at the other end of the impedance elements.

7. The organic EL display of claim 6, wherein the impedance element is a resistor.

8. The organic EL display of claim 6, wherein the impedance element is a MOS transistor.

9. The organic EL display of claim 6, wherein one end of the organic EL device is connected in common to one end of an adjacent organic EL device to be supplied with the organic EL driving voltage through a common connection terminal.

10. The organic EL display of claim 6, wherein the data signals are constant voltages of on/off level.

* * * * *